US005904893A

United States Patent [19]

Stein

[11] Patent Number: 5,904,893

[45] Date of Patent: May 18, 1999

[54] PLATE COOLER FOR METALLURGICAL FURNACES, BLAST FURNACES, DIRECT REDUCTION REACTORS AND GASSING UNITS PROVIDED WITH A REFRACTORY LINING PARTICULARLY FOR THE IRON AND STEEL INDUSTRY

[75] Inventor: Ulrich Stein, Siegen, Germany

[73] Assignees: SMS Schloemann-Siemag AG, Düsseldorf, Germany; Hundt & Weber GmbH, Siegen, Germany

[21] Appl. No.: 08/888,981

[22] Filed: Jul. 7, 1997

[30] Foreign Application Priority Data

Jul. 5, 1996 [DE] Germany ..... 296 11 704

[51] Int. Cl.[6] ..... C21B 7/10

[52] U.S. Cl. ..... 266/46; 266/193; 266/194

[58] Field of Search ..... 266/193, 194, 266/44, 46; 122/6 A, 6 B

[56] References Cited

U.S. PATENT DOCUMENTS

| | | | |
|---|---|---|---|
| 2,256,179 | 9/1941 | Thomson | 266/193 |
| 4,382,585 | 5/1983 | Fischer | 266/193 |
| 5,650,119 | 7/1997 | Hille et al. | 266/193 |
| 5,676,908 | 10/1997 | Kubbutat et al. | 266/193 |
| 5,678,806 | 10/1997 | Hille et al. | 266/193 |

FOREIGN PATENT DOCUMENTS

| | | |
|---|---|---|
| 0 705 906 A1 | 10/1994 | European Pat. Off. . |
| 29 07 511 C2 | 3/1986 | Germany . |
| 195 45 048 A1 | 11/1996 | Germany . |
| 195 45 984 A1 | 6/1997 | Germany . |

*Primary Examiner*—Scott Kastler
*Attorney, Agent, or Firm*—McGlew and Tutttle, P.C.

[57] ABSTRACT

A plate cooler is provided for metallurgical furnaces lined with a refractory lining, comprising cast copper or a low-alloy copper alloy with coolant ducts arranged in its interior. The coolant ducts are prefabricated, comprising copper pipe sockets, copper pipelines and copper pipe bends which are cast integrally in the plate cooler. The wall of the plate cooler facing the interior of the furnace has webs and grooves or a flat surface.

13 Claims, 5 Drawing Sheets

PLATE COOLER FOR METALLURGICAL FURNACES, BLAST FURNACES, DIRECT REDUCTION REACTORS AND GASSING UNITS PROVIDED WITH A REFRACTORY LINING PARTICULARLY FOR THE IRON AND STEEL INDUSTRY

FIELD OF THE INVENTION

The present invention pertains to a plate cooler for metallurgical furnaces, blast furnaces, direct reduction reactors and gassing units provided with a refractory lining, particularly for the iron and steel industry comprising cast copper or a low-alloyed copper alloy with coolant ducts arranged in its interior.

BACKGROUND OF THE INVENTION

Such copper plate coolers are usually arranged between the furnace shell and the furnace lining and are connected to the cooling system of the metallurgical furnace. The cooling elements on the side facing the interior of the furnace are extensively provided with a refractory material in blast furnaces, whereas the copper cooling elements in steel-melting furnaces are inserted in the upper part of the furnace over the refractory lining.

Plates made of cast copper have been known, in which the cooling ducts are formed by integrally cast steel pipes. An oxide film in the integrally cast steel pipes, as well as an insufficient connection between the steel pipe and the copper plate hinders a uniform dissipation of heat.

A plate cooler has been known from DE 29 07 511 C2, which is made of a forged or rolled ingot and in which the cooling ducts are vertically extending blind holes, which are prepared by mechanical deep drilling. The desired position of the holes in terms of height and lateral position is maintained accurately, and uniform dissipation of heat is guaranteed as a result.

The plate cooler is provided with webs and grooves on the side facing the interior of the furnace and may be lined with refractory bricks or with a refractory tamping clay.

A plate cooler made of a forged or rolled copper tube ingot or copper blank has been known from EP 0 705 906 A1, in which cooling ducts are provided for cooling the edge zones in addition to the vertically extending blind holes, and the cooling ducts are arranged in the edges as vertical or horizontal blind holes of a smaller diameter around the vertically arranged blind holes.

A plate cooler made of a forged or rolled copper tube ingot with vertically extending blind holes has been known from the yet unpublished DE Patent Application No. P 195 45 048.5, wherein the blind holes are equipped with bilateral vertical and horizontal side flanges. A circular cooling ring can be formed within a metallurgical furnace due to the overlapping and connection of the vertical side flanges.

Cooling rings arranged one on top of another or individual plate coolers arranged one on top of another can be connected to one another due to the overlapping and connection of the horizontal side flanges.

A plate cooler made of a forged or roller copper tube ingot, which is inserted in the upper part of a melting furnace, especially an arc furnace, and whose smooth or flat inner side is not protected by a refractory lining, has been known from the yet unpublished DE 195 45 984.9.

SUMMARY AND OBJECTS OF THE INVENTION

The primary object of the present invention is therefore to provide a copper plate cooler, whose thermal conductivity approximately corresponds to that of a forged or rolled plate cooler, but which can be manufactured at a considerably lower cost.

According to the invention, a plate cooler is provided for metallurgical furnaces lined with a refractory lining, comprising cast copper or a low-alloy copper alloy with coolant ducts arranged in its interior. The coolant ducts are prefabricated, comprising copper pipe sockets, copper pipelines and copper pipe bends which are cast integrally in the plate cooler. The wall of the plate cooler facing the interior of the furnace has webs and grooves or a flat surface.

Prefabricated bent copper pipes or coolant ducts, comprising copper pipelines, copper bends and copper pipe sockets, are integrally cast according to the present invention in the plate cooler consisting of cast copper.

Corresponding to the width of the plate cooler, the pipes are arranged in a plurality of rows next to each other and/or one on top of another. The hairpin-like head sides of the cooling ducts are formed either by bent pipes or pipe bends or reversing caps (they are provided at the head sides with copper caps pipe bends or reversing caps). The inlets and outlets are provided with pipe sockets. The complete pipeline is welded together and subsequently checked for tightness by a pressure test at about 15 bar/20 minutes.

The pipes, pipe bends and pipe sockets must, however, have thicker walls than commercially available pipelines, because they are exposed to increased temperatures in the casting mold for several hours after casting.

The completely prefabricated pipeline is placed into the casting mold, fixed in the drag box, and the molten copper is then poured around it, so that the pipeline is embedded in the copper plate after the solidification of the melt.

A slight melting of the thick-walled pipes (this may be over about 1–5 mm) at the pipe wall is achieved during the pouring of the cast copper around the pipeline. Intimate connection is formed between the pipe and the copper poured around it due to the melting in the pipe wall area and a 100% connection with the base material (copper plate/pipe) is achieved, instead. Satisfactory dissipation of heat is guaranteed as a result.

The flow and the velocity of flow of the coolant is improved and harmonized by the rounded course of the pipeline compared with the angular transitions in the drilled cooling ducts of a forged or rolled plate.

Webs and grooves for receiving refractory material, which may either be cast integrally or be machined from a smooth wall, are needed on the wall of the plate cooler facing the interior of the furnace for mounting the cast plate coolers in the blast furnace.

In the case of copper plate coolers for use in an arc furnace, the inner side of the plate is preferably made smooth or flat, because the inner side is not provided with a refractory lining.

If the plate coolers are to be fitted together into a circular cooling ring, bilateral vertical side flanges may be provided.

If a plurality of cooling rings are arranged one on top of another in a metallurgical furnace, the plate coolers may also be provided with horizontal side flanges.

The present invention will be explained in greater detail on the basis of schematic exemplary embodiments.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
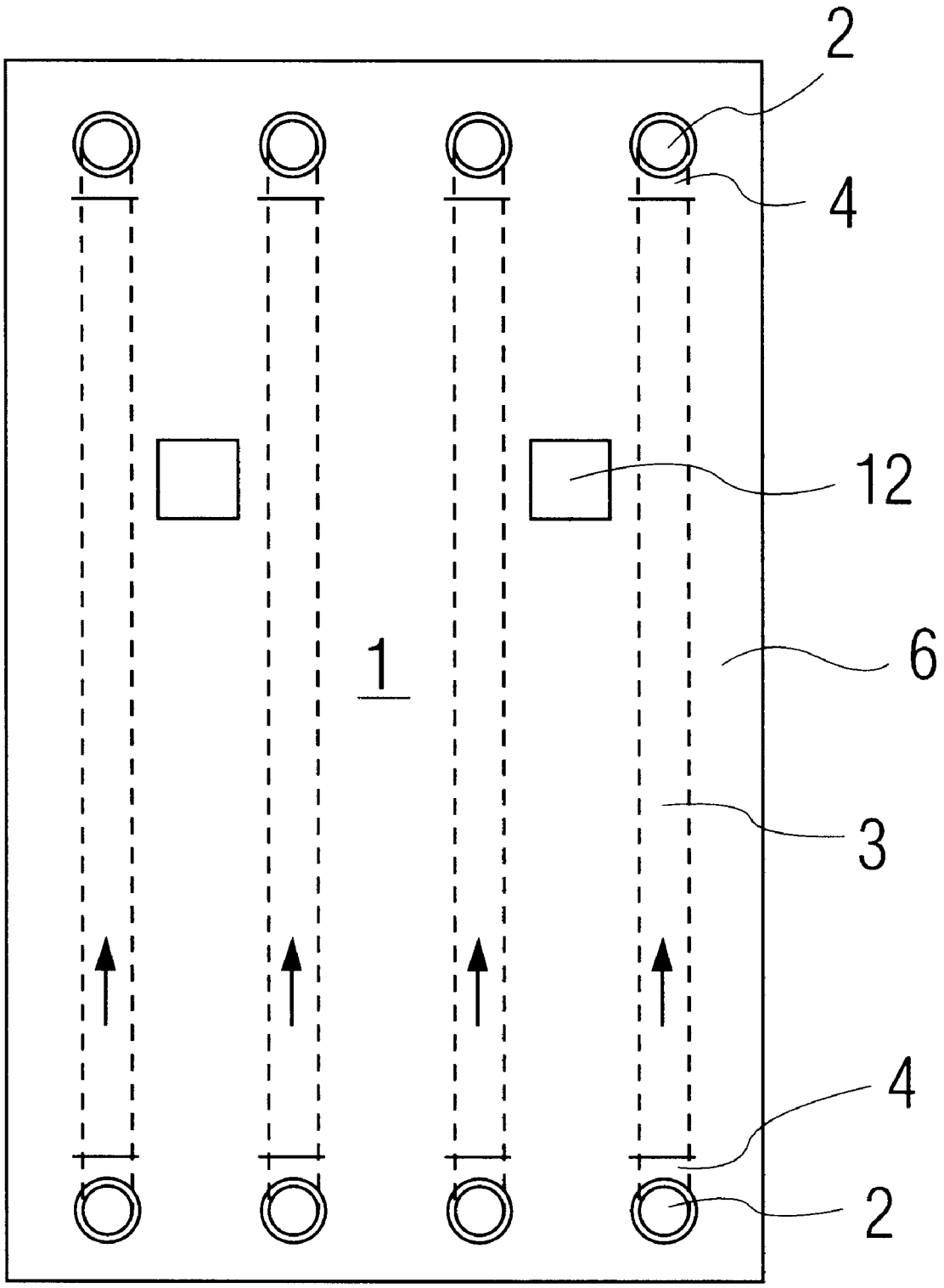
FIG. 1 is a longitudinal view of a plate cooler for use in a blast furnace.

FIG. 1 shows a longitudinal section through the plate cooler 1 with, e.g., four vertically arranged cooling pipelines 2, 3, 4 in the interior of the plate cooler 1 as well as recesses 12 provided in the outer wall 6.

The cooling water is fed into the pipelines 3 from the bottom via the pipe sockets 2 connected to the coolant supply lines of the blast furnace. The coolant lines 2, 3, 4 of the plate cooler 1 are connected as separate cooling circuits to the cooling system of the blast furnace.

Figure 2:
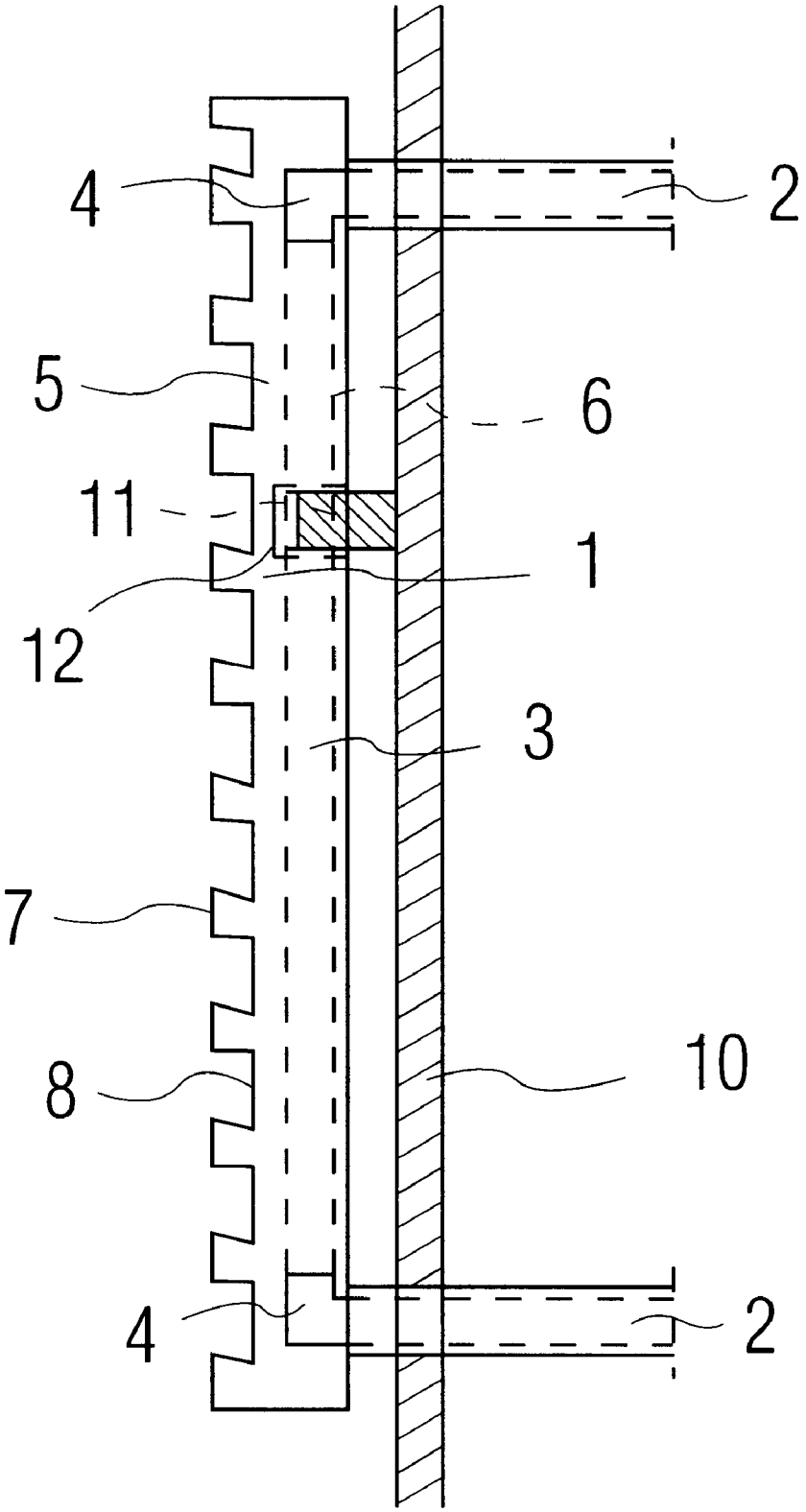
FIG. 2 is a cross sectional view of the plate cooler of FIG. 1.

FIG. 2 shows a section through the plate cooler 1 with the vertically arranged coolant lines 2, 3, 4, which are provided with webs 7 and grooves 8 at the inner wall and with a recess 12 at the outer wall 6, with a supporting pin 11 of the blast furnace jacket 10 engaging the recess 12.

Figure 3:
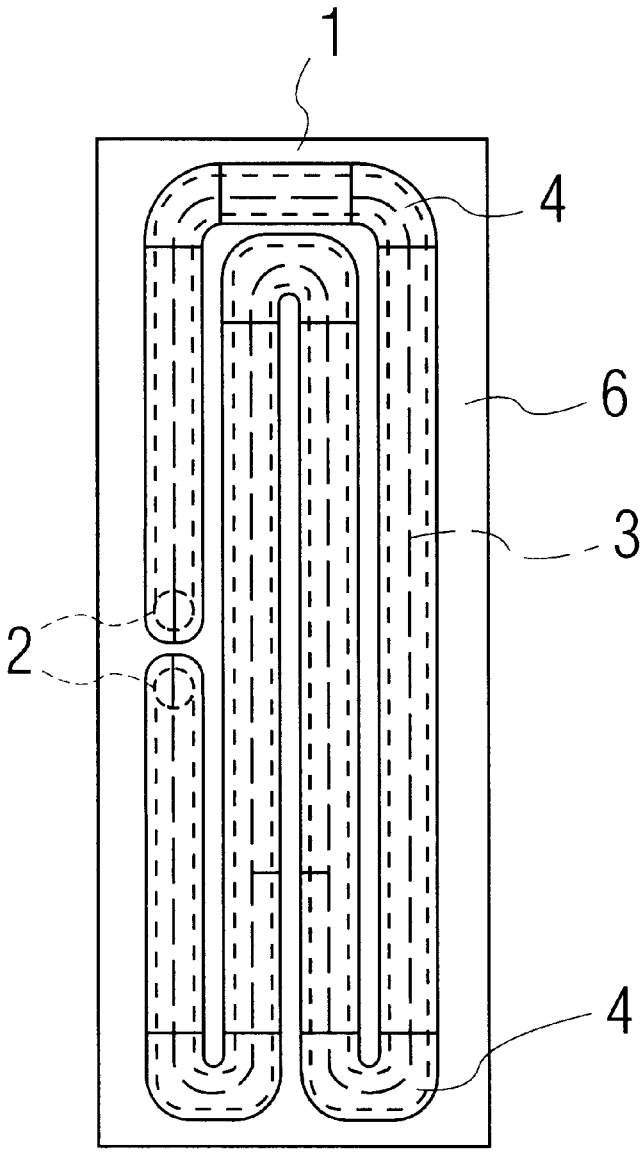
FIG. 3 is a longitudinal view of a plate cooler for use in an arc furnace.

FIG. 3 shows a longitudinal section through a plate cooler 1, which is intended for use in an arc furnace.

The coolant lines 3, 4 are arranged in a coiled pattern and have only two copper pipe sockets 2 for feeding in and drawing off the cooling water. The copper pipelines 3 and copper pipe bends 4 are welded together prior to the casting of the plate cooler; this also applies to the two copper pipe sockets 2.

Figure 4:
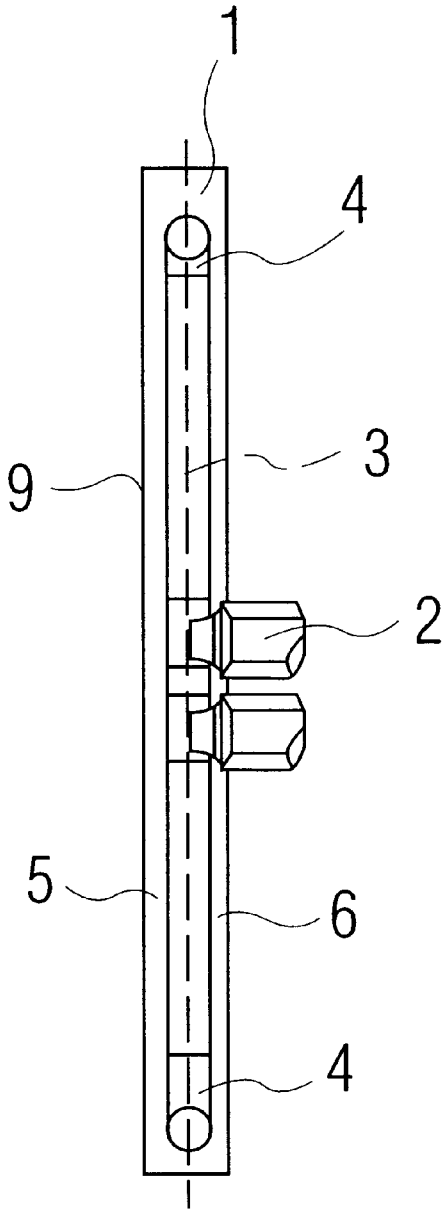
FIG. 4 is a cross sectional view of the plate cooler of FIG. 3.

FIG. 4 shows a cross section through a plate cooler 1, whose inner wall 5 has a flat surface 9. The cooling water is fed in and drawn off through the coolant lines 3, 4 via two copper sockets 2, which are arranged on the outer wall 6 and are connected to the cooling water circuit of the arc furnace.

Figure 5:
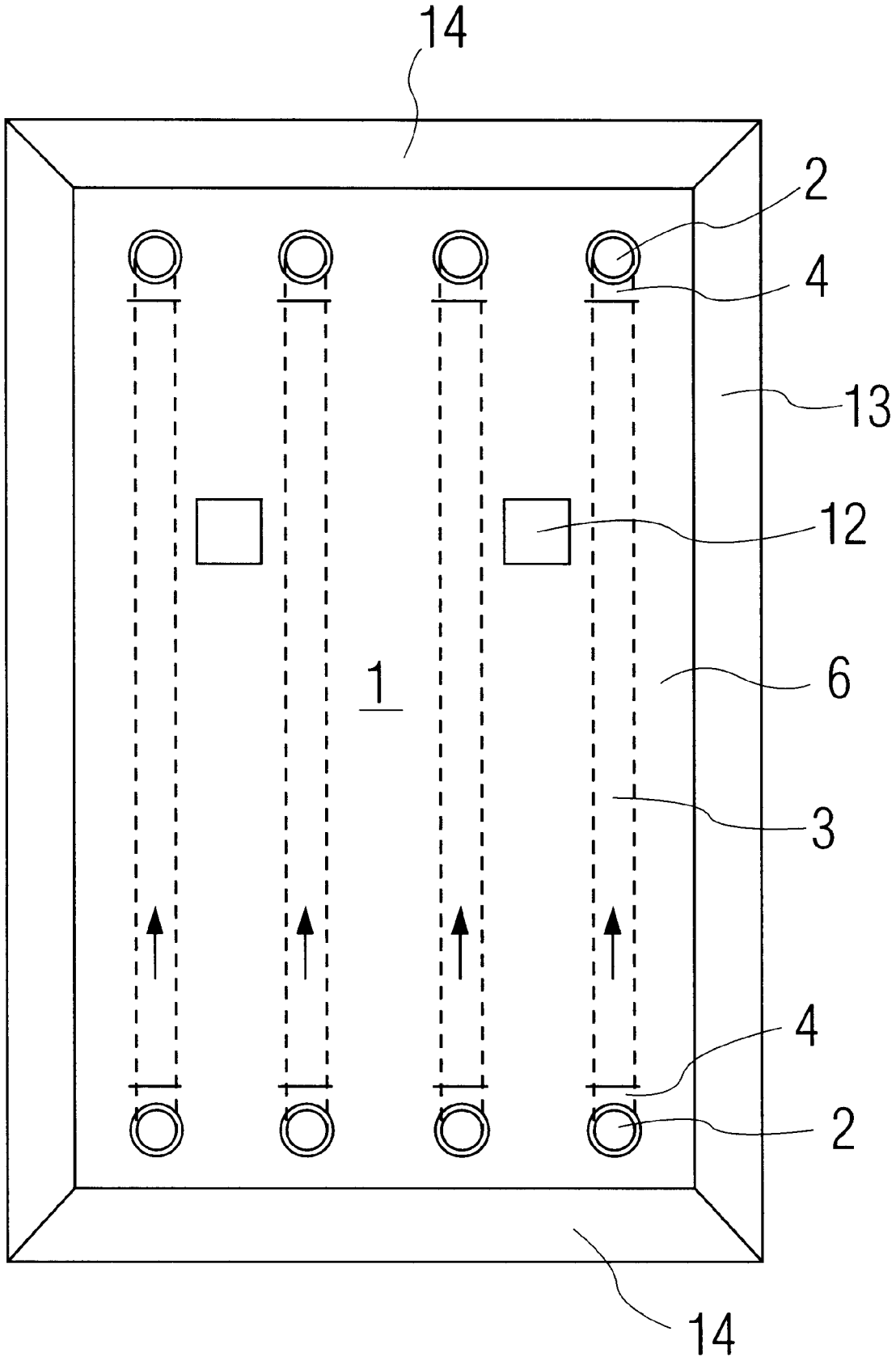
FIG. 5 is a longitudinal view of a plate cooler with vertical and horizontal side flanges.
Figure 6:
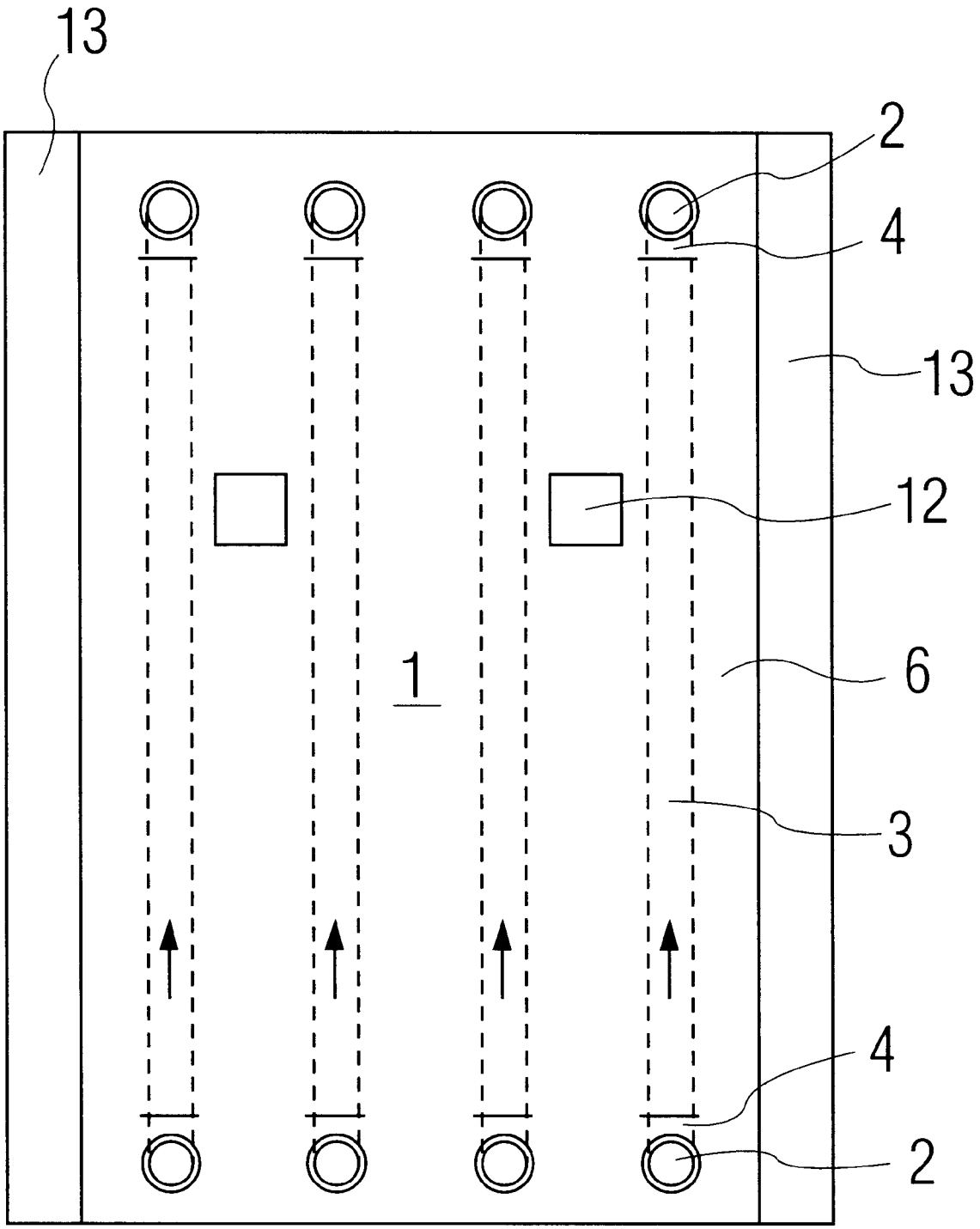
FIG. 6 is a longitudinal view of a plate cooler with vertical side flanges.

FIGS. 5 and 6 show longitudinal sections through two plate coolers 1, which are equipped, contrary to the design according to FIG. 1, with vertical 13 and horizontal side flanges 14 or, according to FIG. 6, with horizontal side flanges 14 only.

Both plate coolers 1 have four vertically arranged cooling pipelines 2, 3, 4 on the inside as well as recesses 12 at the outer wall 6.

The process of forming the plate coolers includes arranging the pipes 2, 3 and 4 in a plurality of rows next to each other corresponding to the width of the plate cooler. The pipes 2, 3 and 4 are provided at the head sides with copper caps (pipe bends or reversing caps). The inlets and outlets are provided with pipe sockets. The complete pipeline is welded together and subsequently checked for tightness by a pressure test at about 15 bar/20 minutes.

The pipes 3, pipe bends 4 and pipe sockets 2 must, however, have thicker walls than commercially available pipelines, because they are exposed to increased temperatures in the casting mold for several hours after casting (and a slight melting will occur).

The completely prefabricated pipeline is placed into the casting mold, fixed in the drag box, and the molten copper is then poured around it, so that the pipeline 2, 3 and 4 is embedded in the copper plate after the solidification of the melt.

A slight melting of the thick-walled pipes over about 1–5 mm at the pipe wall is achieved during the pouring of the cast copper around the pipeline. No gap is formed due to the melting in the pipe wall area, and a 100% connection with the base material (copper plate/pipe) is achieved, instead.

While specific embodiments of the invention have been shown and described in detail to illustrate the application of the principles of the invention, it will be understood that the invention may be embodied otherwise without departing from such principles.

What is claimed is:

1. A plate cooler for metallurgical furnaces, including blast furnaces, direct reduction reactors and gassing units, lined with a refractory lining, comprising:

cast copper or a low-alloy copper alloy with coolant ducts arranged in its interior, said coolant ducts being prefabricated and including at least one of copper pipe sockets, copper pipelines, copper pipe bends and bent copper pipes cast integrally with a remainder of material forming said plate cooler, and a wall of said plate cooler facing the interior of the furnace having either one of webs and grooves or a flat surface.

2. The plate cooler in accordance with claim 1, further comprising: one of bilateral vertical side flanges and bilateral horizontal side flanges.

3. A plate cooler for metallurgical furnaces, including blast furnaces, direct reduction reactors and gassing units lined with a refractory lining, formed by a process comprising the steps of:

arranging pipe parts in a plurality of rows next to each other corresponding to a width of the plate cooler to form a complete pipeline;

welding parts of the complete pipeline together to form a prefabricated pipeline said pipe parts including at least one of copper pipe sockets, copper pipelines, copper pipe bends and bent copper pipes;

placing the completely prefabricated pipeline into a casting mold, fixed in a drag box;

pouring molten copper around said prefabricated pipeline, so that the prefabricated pipeline is embedded in a copper plate after the solidification of the melt wherein said pipe parts and said melt when solidified comprise cast copper or a low-alloy copper alloy;

providing a plurality of copper plates positioned adjacent to each other to form a circular cooling ring within the metallurgical furnace.

4. The plate cooler in accordance with claim 3, further comprising the step of: checking said prefabricated pipeline for tightness by a pressure test at about 15 bar for 20 minutes.

5. The plate cooler in accordance with claim 3, wherein a wall of the plate cooler facing the interior of the furnace has one of webs and grooves and a flat surface.

6. The plate cooler in accordance with claim 5, further comprising the step of:

providing said pipe parts at head sides with copper caps, copper pipe bends, or copper reversing caps and providing inlets and outlets with pipe sockets.

7. The plate cooler in accordance with claim 3, further comprising: at least one of bilateral vertical and horizontal side flanges.

8. The plate cooler in accordance with claim 4, further comprising: bilateral vertical side flanges or bilateral horizontal side flanges.

9. A method of forming a plate cooler for metallurgical furnaces, comprising the steps of:

arranging pipe parts in a plurality of rows next to each other corresponding to a width of the plate cooler to form a complete pipeline;

welding parts of the complete pipeline together to form a prefabricated pipeline, said pipe parts including at least one of copper pipe sockets, copper pipelines, copper pipe bends and bent copper pipes;

placing the completely prefabricated pipeline into a casting mold, fixed in a drag box;

pouring molten copper around said prefabricated pipeline, so that the prefabricated pipeline is embedded in the copper plate after the solidification of the melt, wherein said pipe parts and said melt when solidified comprise cast copper or a low-alloy copper alloy;

providing a plurality of copper plates positioned adjacent to each other to form a circular cooling ring within the metallurgical furnace.

10. The method according to claim 9, further comprising the step of: checking said prefabricated pipeline for tightness by a pressure test at about 15 bar for 20 minutes.

11. The plate cooler in accordance with claim 1, further comprising a recess formed in an outer wall of the cooler and a supporting pin of a blast furnace jacket engaging said recess.

12. A plate cooler arrangement for iron and steel industry metallurgical furnaces, blast furnaces, direct reduction reactors and gassing units, the plate cooler arrangement comprising:

a cast copper or a low-alloy copper alloy plate cooler with coolant ducts arranged in its interior, said coolant ducts being prefabricated and including an inlet and an outlet with copper pipe sockets and copper pipe lines and copper pipe bends connecting said inlet and said outlet, said copper pipe lines and said copper pipe bends being cast integrally with a remainder of material forming said plate cooler, said plate cooler having an inner wall facing the interior of the furnace, said inner wall having either one of webs and grooves or a flat surface and an outer wall of the plate cooler facing the exterior of the metallurgical furnace with support means for supporting a weight of the cooler at a location other than adjacent to said inlet and said outlet;

another cast copper or a low-alloy copper alloy plate cooler with coolant ducts arranged in its interior, said coolant ducts being prefabricated and including an inlet and an outlet with copper pipe sockets and copper pipe lines and copper pipe bends connecting said inlet and said outlet, said copper pipe lines and said copper pipe bends being cast integrally with a remainder of material forming said another plate cooler, said another plate cooler having am inner wall facing the interior of the furnace, said inner wall having either one of webs and grooves or a flat surface and an outer wall of the plate cooler facing the exterior of the metallurgical furnace with support means for supporting a weight of the cooler at a location other than adjacent to said inlet and said outlet;

a blast furnace jacket with a supporting pins for supporting said plate cooler and said another plate cooler as well as additional plate coolers to completely cover an entire wall surface in a lower part of the surface; and a refractory lining covering said inner wall of each of said platen cooler, said another plate cooler and said additional plate coolers.

13. The plate cooler in accordance with claim 12, wherein said support means includes a recess formed in said outer wall and a supporting pin of a blast furnace jacket engaging said recess.

* * * * *